US011326858B2

(12) United States Patent
Steen

(10) Patent No.: US 11,326,858 B2
(45) Date of Patent: May 10, 2022

(54) REUSABLE SHOOTING TARGET

(71) Applicant: Jim Steen, Spring Valley, CA (US)

(72) Inventor: Jim Steen, Spring Valley, CA (US)

( * ) Notice: Subject to any disclaimer, the term of this patent is extended or adjusted under 35 U.S.C. 154(b) by 0 days.

(21) Appl. No.: 16/503,365

(22) Filed: Jul. 3, 2019

(65) Prior Publication Data

US 2020/0018577 A1 Jan. 16, 2020

Related U.S. Application Data

(60) Provisional application No. 62/695,957, filed on Jul. 10, 2018.

(51) Int. Cl.
*F41J 7/04* (2006.01)

(52) U.S. Cl.
CPC ..... *F41J 7/04* (2013.01)

(58) Field of Classification Search
CPC ..... F41J 7/04; F41J 1/10; F41J 7/00
See application file for complete search history.

(56) References Cited

U.S. PATENT DOCUMENTS 951,377 A * 3/1910 Metzger ..... F41J 7/04 273/391
1,269,942 A * 6/1918 Kempinski ..... F41J 7/04 273/391
1,348,442 A * 8/1920 Prebble ..... F41J 7/04 273/390
1,569,781 A * 1/1926 Orr ..... F41J 7/04 273/392
1,733,606 A * 10/1929 Junker ..... A63F 9/02 273/375
2,691,526 A * 10/1954 Robert ..... F41J 7/04 273/359
3,411,784 A * 11/1968 Lawrence ..... F41J 7/04 273/388
3,554,550 A * 1/1971 Schram ..... A63B 67/06 273/388
3,575,415 A * 4/1971 Fulp ..... A63B 63/00 273/400
3,690,664 A * 9/1972 Hauke ..... A63F 9/0204 273/127 D
3,817,528 A * 6/1974 Stuhler ..... F41J 1/10 273/393
3,899,170 A * 8/1975 Parks ..... A63F 9/02 473/107

(Continued)

*Primary Examiner* — Melba Bumgarner
*Assistant Examiner* — Amir A Klayman
(74) *Attorney, Agent, or Firm* — Tilman Wright, PLLC; James D. Wright; David R. Higgins

(57) ABSTRACT

A reusable shooting target or target system may include multiple rotary targets each having a target plate section having a bottom end, a top end, a front end, and a back end, and a pivot section. The target may include crossbars having a first end, a body portion, and a second end, front legs and back legs. The pivot section of each rotary target is fixedly or removably attached to the body section of one of the crossbars such that the target plate section of the rotary target is positioned below the crossbar to which the pivot section is attached. The pivot section of each rotary target and the crossbar to which the pivot section is attached are together adapted such that when hit with a bullet the rotary target spins around an axis aligned with the respective crossbar to which the rotary target is attached.

14 Claims, 8 Drawing Sheets

(56) References Cited

U.S. PATENT DOCUMENTS 4,568,085 A * 2/1986 Tate ..... A63F 7/3065 273/127 D
4,583,744 A * 4/1986 Tolliver ..... F41J 13/02 273/378
4,588,194 A * 5/1986 Steidle ..... F41J 7/04 273/391
4,961,587 A * 10/1990 Galvin ..... A63B 63/06 273/375
5,036,613 A * 8/1991 Smith ..... F41A 23/12 42/94
5,181,721 A * 1/1993 Halliburton ..... A63B 63/00 273/378
5,263,722 A * 11/1993 Rosellen ..... F41J 7/04 273/391
5,280,919 A * 1/1994 Graham ..... F41J 1/01 273/381
5,342,062 A * 8/1994 Lance ..... F41J 1/10 273/391
6,478,301 B1 * 11/2002 Witmeyer ..... F41J 7/04 273/378
6,656,063 B2 * 12/2003 Prichard ..... A63B 69/0091 473/139
6,779,797 B1 * 8/2004 Chou ..... F41J 7/04 273/391
6,889,982 B1 * 5/2005 Gove ..... A63B 63/00 273/343
6,896,267 B1 * 5/2005 Le Anna ..... F41J 7/04 273/391
7,114,725 B2 * 10/2006 Camp ..... F41J 1/10 273/390
7,175,181 B1 * 2/2007 Bateman ..... F41J 7/04 273/392
7,845,646 B1 * 12/2010 Weber ..... F41J 1/01 273/407
8,172,231 B2 * 5/2012 Massier ..... F41J 9/02 273/406
8,469,364 B2 * 6/2013 Bassett ..... F41J 13/00 273/410
8,794,629 B1 * 8/2014 Humphreys, Jr. ..... A63F 1/04 273/400
9,631,906 B2 * 4/2017 English ..... F41J 5/052
10,088,179 B2 * 10/2018 Hirsch ..... F24F 3/08
10,272,310 B2 * 4/2019 Besherse ..... A63B 69/0002
10,881,932 B2 * 1/2021 Burns ..... A63B 67/06
2006/0082067 A1 * 4/2006 Wong ..... A63B 63/004 273/410
2011/0068538 A1 * 3/2011 Kuyl ..... F41J 1/10 273/407
2014/0131950 A1 * 5/2014 Lee ..... F41J 1/10 273/378
2014/0265135 A1 * 9/2014 Saunders ..... F41J 1/01 273/392
2017/0219320 A1 * 8/2017 Loetz, Jr ..... F41J 7/04
2018/0216920 A1 * 8/2018 Allison ..... F41J 1/10
2019/0316884 A1 * 10/2019 Pittman ..... F41J 1/01

* cited by examiner

REUSABLE SHOOTING TARGET

BACKGROUND

The present disclosure relates to the fields of materials and mechanical engineering. More specifically, the present disclosure relates to a reusable shooting target and various embodiments thereof.

SUMMARY

Some embodiments described herein relate to a reusable shooting target having one or more crossbars with rotary targets that spin around an axis perpendicular to the line of sight of the shooter, providing the shooter or others with a visual indication of where the bullet passed. In some embodiments, the distance between individual rotary targets on a specific crossbar is less than the width of common bullets to prevent bullets from passing between the rotary targets. In some embodiments, the distance between any of crossbars is large enough so that when an individual rotary target spins, it does not collide with another rotary target or crossbar.

In one aspect, a reusable shooting target is disclosed. The reusable shooting target includes, for example, a plurality of rotary targets, each individual rotary target having a target plate section having a bottom end, a top end, a front end, and a back end, and a pivot section. In some embodiments, the top end of the target plate section is fixedly or removably attached to the pivot section; and wherein the front end and the back end of the target plate section are substantially flat. In some embodiments, the reusable shooting target further includes a plurality of crossbars, each crossbar having a first end, a body portion, and a second end, two or more front legs, each individual front leg a bar including a bottom end; a body portion; and a top end, and a plurality of back legs, each individual back leg a bar including a back end; a body portion; and a front end. In some embodiments, the body portion or top end of each individual front leg is fixedly attached to the front end of one of the back legs, the first end of each individual crossbar is fixedly or removably attached to the body portion of one of the back legs, the second end of each individual crossbar is fixedly or removably attached to the body portion of another one of the back legs. In some embodiments, the pivot section of each individual rotary target is fixedly or removably attached to the body section of one of the crossbars, such that the target plate section of the rotary target is positioned below the crossbar to which the pivot section is attached. In some embodiments, the pivot section of each individual rotary target and the crossbar to which the pivot section is attached are together adapted such that when hit with a bullet the rotary target spins around an axis aligned with the respective crossbar to which the rotary target is attached. In some embodiments, the individual rotary targets adjacent to each other on an individual crossbar are separated from one another by a distance $d_1$, and $d_1$ is less than 0.500 inches. In some embodiments, the individual crossbars adjacent to each other are separated by a distance $d_2$, and $d_2$ is a value large enough so that an individual spinning rotary target will not collide with another rotary target or crossbar. In some embodiments, each of the front legs, the back legs, the crossbars, and the rotary targets are include or are formed of at least one bullet-resistant material.

In some embodiments, the $d_1$ is less than 0.200 inches. In some embodiments, the $d_1$ is less than 0.100 inches. In some embodiments, the $d_1$ is 0.04 inches to 0.370 inches. In some embodiments, the $d_1$ is 0.04 inches to 0.320 inches. In some embodiments, the $d_1$ is 0.04 inches to 0.280 inches. In some embodiments, the $d_1$ is 0.04 inches to 0.215 inches. In some embodiments, the $d_1$ is 0.04 inches to 0.165 inches. In some embodiments, the front legs, the back legs, the crossbars, or the rotary targets include or are formed of mild steel. In some embodiments, the front legs, the back legs, the crossbars, and the rotary targets include or are formed of steel with a Brinell value of about 400 to 500 HB. In some embodiments, the front legs, the back legs, the crossbars, and the rotary targets include or are formed of steel with a Brinell value of about 500 to 700 HB. In some embodiments, the front legs, the back legs, the crossbars, and the rotary targets include or are formed of steel with Brinell value of about 505 to 600 HB. In some embodiments, the front legs, the back legs, the crossbars, and the rotary targets include or are formed of steel with a Brinell value of about 510 to 575 HB. In some embodiments, the front legs, the back legs, the crossbars, and the rotary targets include or are formed of steel with a Brinell value of about 515 to 540 HB. In some embodiments, the target plate sections are attached to the pivot sections by tungsten inert gas welds or other weld processes. In some embodiments, the target plate sections comprise at least one weather-resistant coating or decorative paint.

In some embodiments, the body portion of the back legs comprise a plurality of holes configured to receive the first ends or the second ends of the crossbars. In some embodiments, the first end of each crossbar is mated with one of the holes of a back leg and extends through the crossbar to the opposite side. In some embodiments, the second end of each crossbar is mated with one of the holes of a back leg and extends through the crossbar to the opposite side. In some embodiments, each first end and second end of the crossbars is secured to a nut. In some embodiments, the rotary targets are separated the back legs by thread and nuts. In some embodiments, the rotary targets are separated the back legs by washers or bolts.

In some embodiments, the bottom end of each of the two or more front legs is configured to rest upon a support surface. In some embodiments, the bottom end of each of the two or more front legs is configured to be fixedly or removably attached to a support surface. In some embodiments, the bottom end of each of the two or more front legs is configured to be fixedly or removably inserted into a support surface. In some embodiments, the back end of each individual back leg a bar of the plurality of back legs is configured to rest upon the support surface. In some embodiments, the back end of each individual back leg a bar of the plurality of back legs is configured to be fixedly or removably attached to the support surface. In some embodiments, the back end of each individual back leg a bar of the plurality of back legs is configured to be fixedly or removably inserted into the support surface.

In another aspect, a shooting target system is provided. The system may include, for example, a reusable shooting target, including a plurality of rotary targets, each individual rotary target comprising a target plate section having a bottom end, a top end, a front end, and a back end, and a pivot section, the top end of the target plate section fixedly or removably attached to the pivot section, and the front end and the back end of the target plate section are substantially flat. The system may include, for example, a plurality of crossbars, each crossbar comprising a first end, a body portion, and a second end, two front legs, each individual front leg a bar comprising a bottom end, a body portion, and a top end, and a plurality of back legs, each individual back leg a bar comprising a back end, a body portion, and a front end. The system may include, for example, a shield attached to the reusable shooting target and configured to protect the two front legs.

In some embodiments, the shield includes a body and two support rods, each of the two support rods connected to the body by a plate. In some embodiments, the two support rods are removably attached to the shooting target by each fitting within a hollow space at the corresponding top of the two front legs.

BRIEF DESCRIPTION OF THE DRAWINGS

The features and advantages of the systems, devices, and methods described herein will become apparent from the following description, taken in conjunction with the accompanying drawings. These drawings depict only several embodiments in accordance with the disclosure and are not to be considered limiting of its scope. In the drawings, similar reference numbers or symbols typically identify similar components, unless context dictates otherwise. The drawings may not be drawn to scale.

FIG. 3*b* also illustrates the distance 137 between individual rotary targets 130 on a specific crossbar 115, which in preferred embodiments is less than the width of common bullets to prevent them from passing between the rotary targets 130.

DETAILED DESCRIPTION OF PREFERRED EMBODIMENTS

Figure 1:
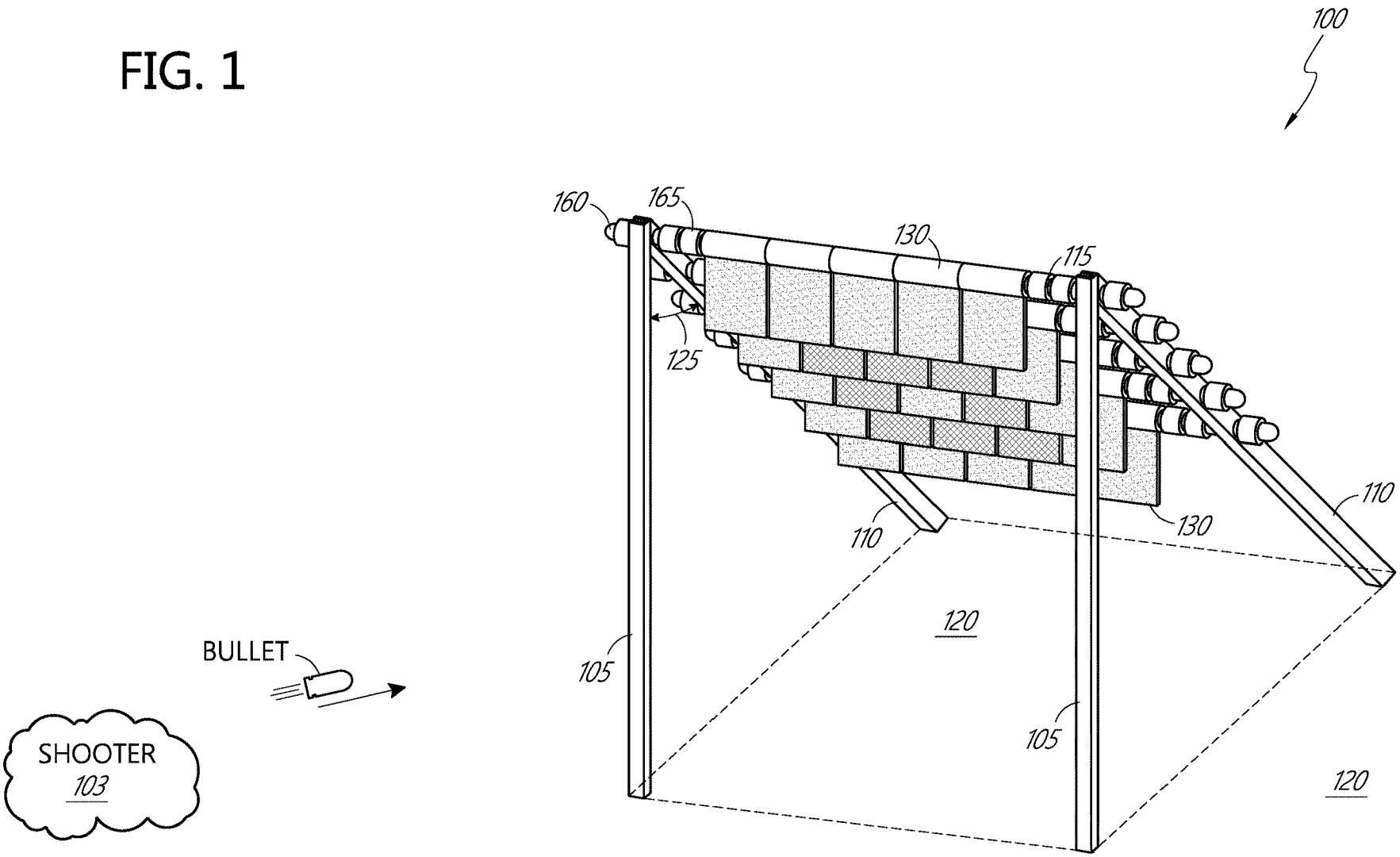
FIG. 1 illustrates an exemplary embodiment of the shooting target 100.

FIG. 1 illustrates an exemplary embodiment of the shooting target 100. The exemplary shooting target 100 includes nine frame elements: two front legs 105, two back legs 110, and five crossbars 115. When connected, these nine frame elements, together with the support surface 120 to which the shooting target 100 rests, is attached, or is inserted, form a frame substantially in the shape of a triangular prism.

"Front" as used herein indicates than an element holds a position closer to shooter 103 than the corresponding "back" element. The two front legs 105 include bars oriented substantially parallel to one another, wherein each bar is configured to connect to one of the two back legs 110. When the shooting target 100 is positioned appropriately for operation, front legs 105 are substantially vertical. Moreover, when shooting target 100 is positioned appropriately for operation, the angles 125 between front legs 105 and back legs 110 are valued between 40 and 70 degrees, more preferably between 50 and 60 degrees, and most preferably between 53 and 57 degrees. Front legs 105 can be secured to back legs 110 through any suitable means. For example, front legs 105 can include threaded openings to interlock with threaded sections of back legs 110. Alternatively, front legs 105 can be secured to back legs 110 by welding or by one or more fasteners. In regard to composition, front legs 105 and back legs 110 can include any material suitable for a shooting target. For example, front legs 105 and back legs 110 can include a polycarbonate polymer such as Lexan®, a para-aramid synthetic fiber such as Kevlar®, a carbon fiber composite material, titanium, and/or a hardened steel resistant to plastic deformation, such as martensite. In some embodiments, front and back legs 110 include or are formed of a mild steel. In some embodiments, front and back legs 110 include or are formed of steel with a Brinell value of about 400 to 550 HB. In some embodiments, front and back legs 110 include steel with a Brinell value of about 500 to 900 HB. In some embodiments, front and back legs 100 include or are formed of steel with a Brinell value of about 500 to 700 HB. In some embodiments, front and back legs 110 include or are formed of steel with a Brinell value of about 505 to 600 HB. In some embodiments, front and back legs 110 include or are formed of steel with a Brinell value of about 510 to 575 HB. In preferred embodiments, front and back legs 110 include or are formed of steel with a Brinell value of about 515 to 540 HB. In some embodiments, the lengths of front legs 105 and back legs 110 are adjustable to account for uneven support surfaces 120. In other embodiments, front legs 105 and back legs 110 also include one or more weather-resistant coatings such as coatings including polyurethane, zinc, molybdenum disulfide, polyphenylene sulfide, epoxy, phenol, manganese phosphate, zinc phosphate, or fluorinated polymers such as polytetrafluoroethylene, fluorinated ethylene propylene, polyvinylidene fluoride, or ethylene/chlorotrifluoroethylene copolymers. In other embodiments, front legs 105 and back legs 110 also include a decorative paint.

Back legs 110 are configured to connect to each other via one or more crossbars 115. FIG. 1 illustrates an embodiment with five crossbars 115, which are substantially parallel to one another. However, other embodiments can include a greater or lesser number of crossbars, depending upon the ultimate conditions of use, the ultimate goals of use, the skill level of the shooter, and the overall dimensions of shooting target 100.

Figure 2B:
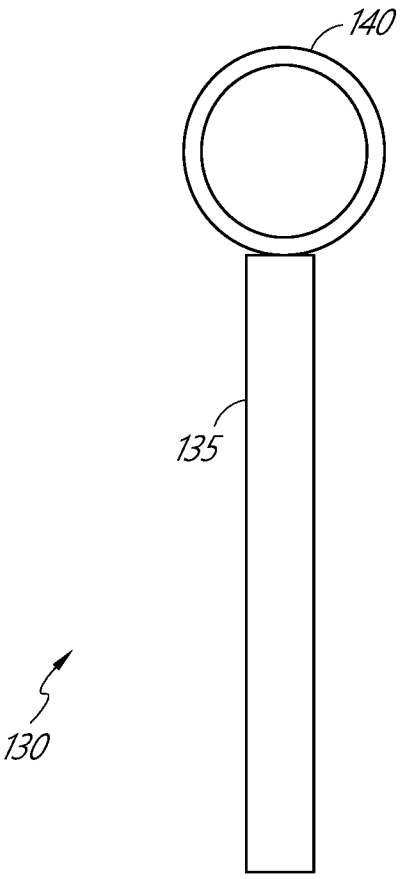
FIGS. 2*a* and 2*b* illustrate a rotary target 130 as viewed from the front or back and as viewed from either side, respectively.
Figure 2A:
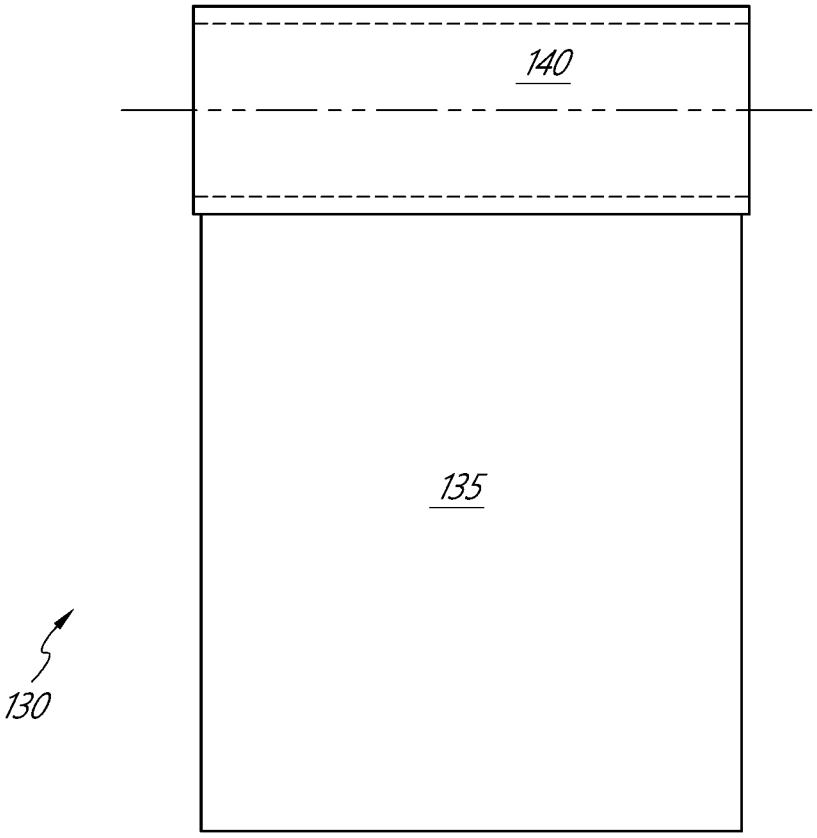

Secured to each of crossbars 115 are rotary targets 130. FIGS. 2*a* and 2*b* illustrate an individual rotary target 130 in greater detail. FIG. 2*a* shows a rotary target 130 as viewed from the front or back, i.e., from an angle perpendicular to the respective crossbar 115 to which the rotary target 130 is attached. FIG. 2*b* shows a rotary target 130 as viewed from either side, i.e., from an angle parallel with the crossbar to which the rotary target is attached. Each rotary target 130 includes a target plate section 135. The target section 135 rests directly below the respective crossbar 115 to which the rotary target 130 is attached, and the front and back of the target plate section 135 is substantially flat. When viewed from the front or back, the target plate section 135 can be of any shape. In preferred embodiments, the target plate section 135 when viewed from the front or back is substantially rectangular or square, as illustrated in FIG. 2*a*.

Each target plate section 135 is secured to a pivot section 140, which is attached to the respective crossbar 115 to which the rotary target 130 is attached, typically in the form of a loop. Both the target plate section 135 and the pivot section 140 of each rotary target 130 can include any material suitable for a shooting target. For example, the target plate section 135 and the pivot section 140 of each rotary target 130 can include a polycarbonate polymer such as Lexan®, a para-aramid synthetic fiber such as Kevlar®, a carbon fiber composite material, titanium, and/or a hardened steel resistant to plastic deformation, such as martensite or a mild steel. In some embodiments, the target plate section 135 and the pivot section 140 of each rotary target 130 include or are formed of a mild steel. In some embodiments, the target plate section 135 and the pivot section 140 of each rotary target 130 include or are formed of steel with a Brinell value of about 400 to 550 HB. In some embodiments, the target plate section 135 and the pivot section 140 of each rotary target 130 include steel with a Brinell value of about 500 to 900 HB. In some embodiments, the target plate section 135 and the pivot section 140 of each rotary target 130 include steel with a Brinell value of about 500 to 700 HB. In some embodiments, the target plate section 135 and the pivot section 140 of each rotary target 130 include steel with a Brinell value of about 505 to 600 HB. In some embodiments, the target plate section 135 and the pivot section 140 of each rotary target 130 include steel with a Brinell value of about 510 to 575 HB. In preferred embodiments, the target plate section 135 and the pivot section 140 of each rotary target 130 include steel with a Brinell value of about 515 to 540 HB. In some embodiments, the target plate section 135 and the pivot section 140 of each rotary target 130 include different bullet-resistant materials.

Moreover, the target plate section 135 can be secured to the pivot section 140 through any suitable means. In some embodiments, the target plate section 135 is secured to the pivot section 140 by a weld. In preferred embodiments, the weld securing target plate section 135 to pivot section 140 is a tungsten inert gas weld. In other embodiments, the weld securing target plate section 135 to pivot section 140 is a plasma arc weld or other weld process. In some embodiments, target plate section 135 and pivot section 140 include one continuous metal sheet, wherein the metal sheet is bent or otherwise shaped into a loop around the respective crossbar 115, and the metal sheet is welded onto itself to secure the rotary target 130 to its respective crossbar 115. In some embodiments, that weld onto itself is on the backside of the rotary target 130, so that the weld is shielded from approaching bullets.

Figure 3A:
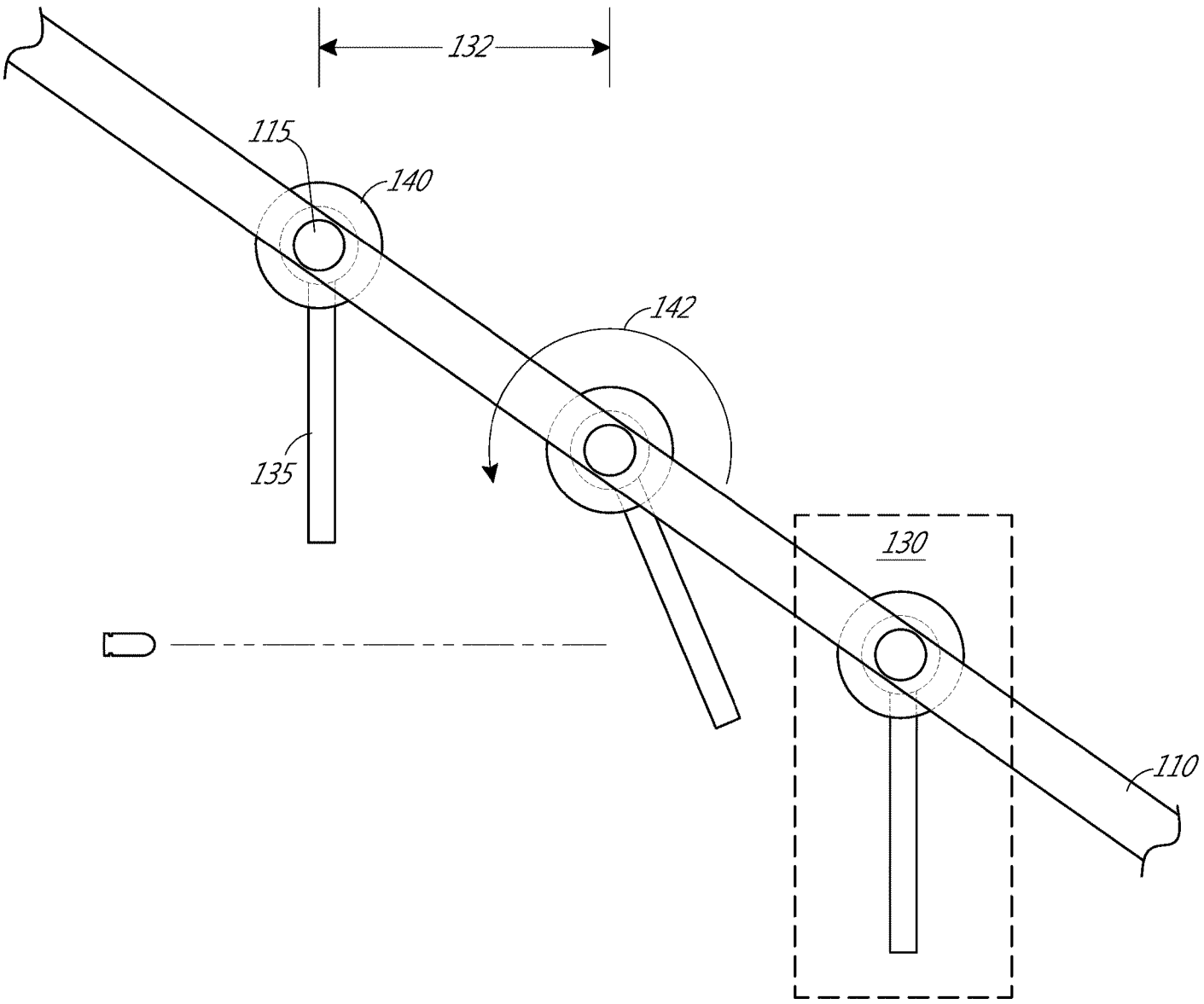
FIG. 3*a* illustrates the positioning of an individual rotary target 130 and individual crossbar 115 relative to other rotary targets 130 and crossbars 115. This figure also illustrates how an individual rotary target 130, when struck with a bullet, spins to provide the shooter or others with a visual indication of where the bullet passed in a rotation 142.
Figure 3B:
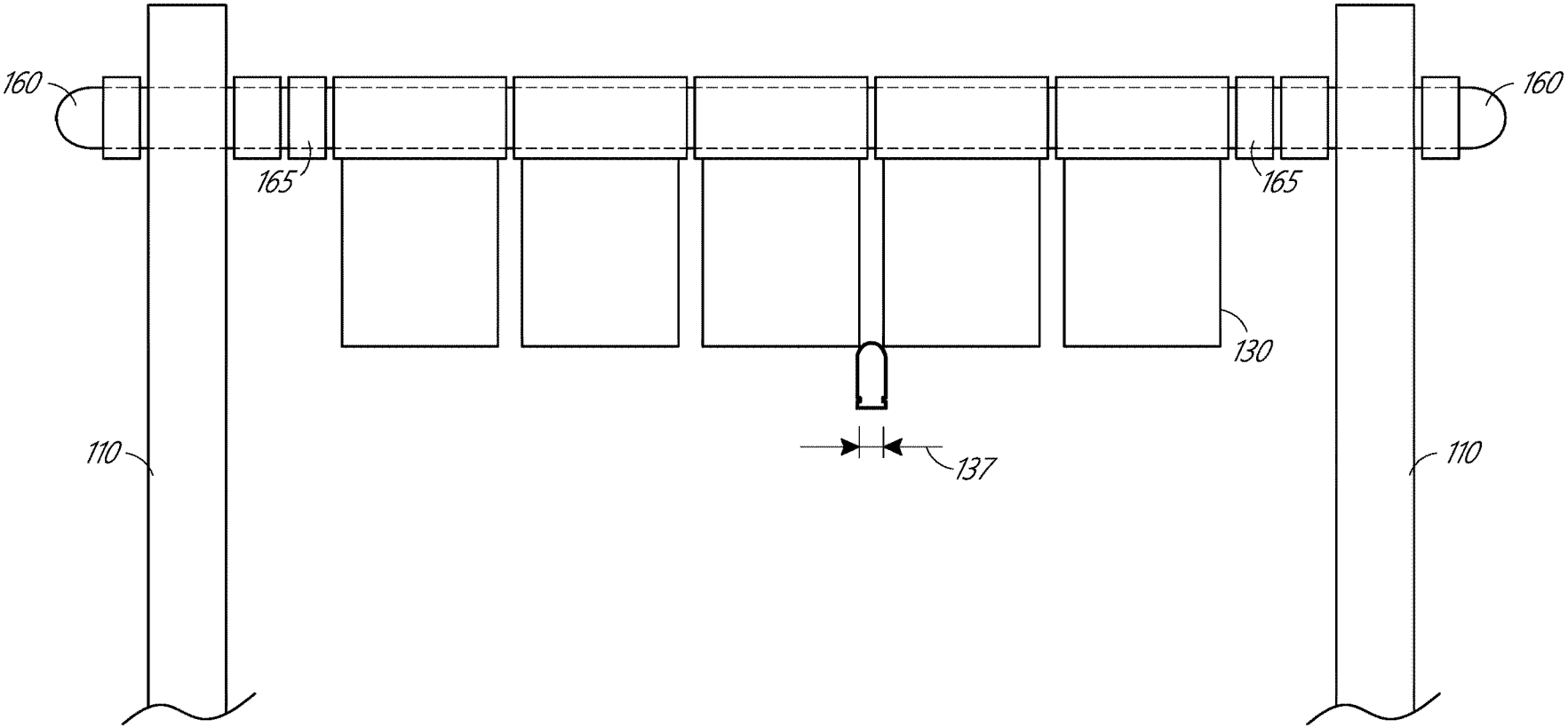
FIG. 3*b* illustrates an embodiment of how crossbars 115 and back legs 105 can be configured to connect to one another. In this embodiment, crossbars 115 extend through the back legs 110.

As shown in FIG. 3*a*, when hit with a bullet, an individual rotary target 130 spins around an axis aligned with the respective crossbar 115 to which the rotary target 130 is attached, providing the shooter or others with a visual indication of where the bullet struck. The spinning of the individual rotary target 130 creates a rotation 142. The distance 132 between any of crossbars 115 is large enough so that when an individual rotary target 130 spins in the rotation 142, it does not collide with another rotary target 130 or crossbar 115. Referring to FIG. 3*b*, the distance 137 between individual rotary targets 130 on a specific crossbar 115 can be any length. For example, the distance 137 between individual rotary targets 130 on a specific crossbar 115 can be 0.495 inches, 0.445 inches, 0.435 inches, 0.395 inches, 0.370 inches, 0.360 inches, 0.355 inches, 0.345 inches, 0.335 inches, 0.330 inches, 0.320 inches, 0.310 inches, 0.305 inches, 0.280 inches, 0.265 inches, 0.255 inches, 0.245 inches, 0.240 inches, 0.220 inches, 0.215 inches, 0.200 inches. 0.180 inches, 0.170 inches, 0.100 inches, and 0.040 inches. In preferred embodiments, the distance 137 between individual rotary targets 130 on a specific crossbar 115 less than 0.220 inches, more preferably less than 0.170 inches, or even more preferably 0.100 inches to prevent bullets from passing between the rotary targets 130. In some cases, larger gaps may exist.

Referring back to FIG. 1, an exemplary embodiment of shooting target 100 contains five rotary targets 130 per row and twenty-five rotary targets 130 in total. However, other embodiments can contain any number of rotary targets 130 per row and in total to accommodate shooter skill level and/or operating conditions. The rotary targets 130 are optionally separated from each other and from back legs 110 by bolts 165 or by washers, or nuts or any other suitable means for reducing mechanical wear and/or increasing structural support. In some embodiments, rotary targets 130 also include one or more weather-resistant coatings such as coatings including polyurethane, zinc, molybdenum disulfide, polyphenylene sulfide, epoxy, phenol, manganese phosphate, zinc phosphate, or fluorinated polymers such as polytetrafluoroethylene, fluorinated ethylene propylene, polyvinylidene fluoride, or ethylene/chlorotrifluoroethylene copolymers. In some embodiments, one or more rotary target 130 also includes a decorative paint. In some embodiments, one or more rotary target 130 also includes decorative paint such that the overall painted pattern formed by rotary targets 130 is in the shape of a bullseye. In some embodiments, one or more rotary target 130 also includes decorative paint such that the overall painted pattern formed by rotary targets 130 is in the shape of an animal or a portion of an animal. In some embodiments, one or more rotary target 130 also includes decorative paint such that the overall painted pattern formed by rotary targets 130 is in an alternative shape. In some embodiments, the rotary targets 130 also include decorative paint, and the rotary targets 130 alternate in paint color, or between painted and unpainted, to aid in visually perceiving the individual rotary targets 130 from a distance.

Figure 4:
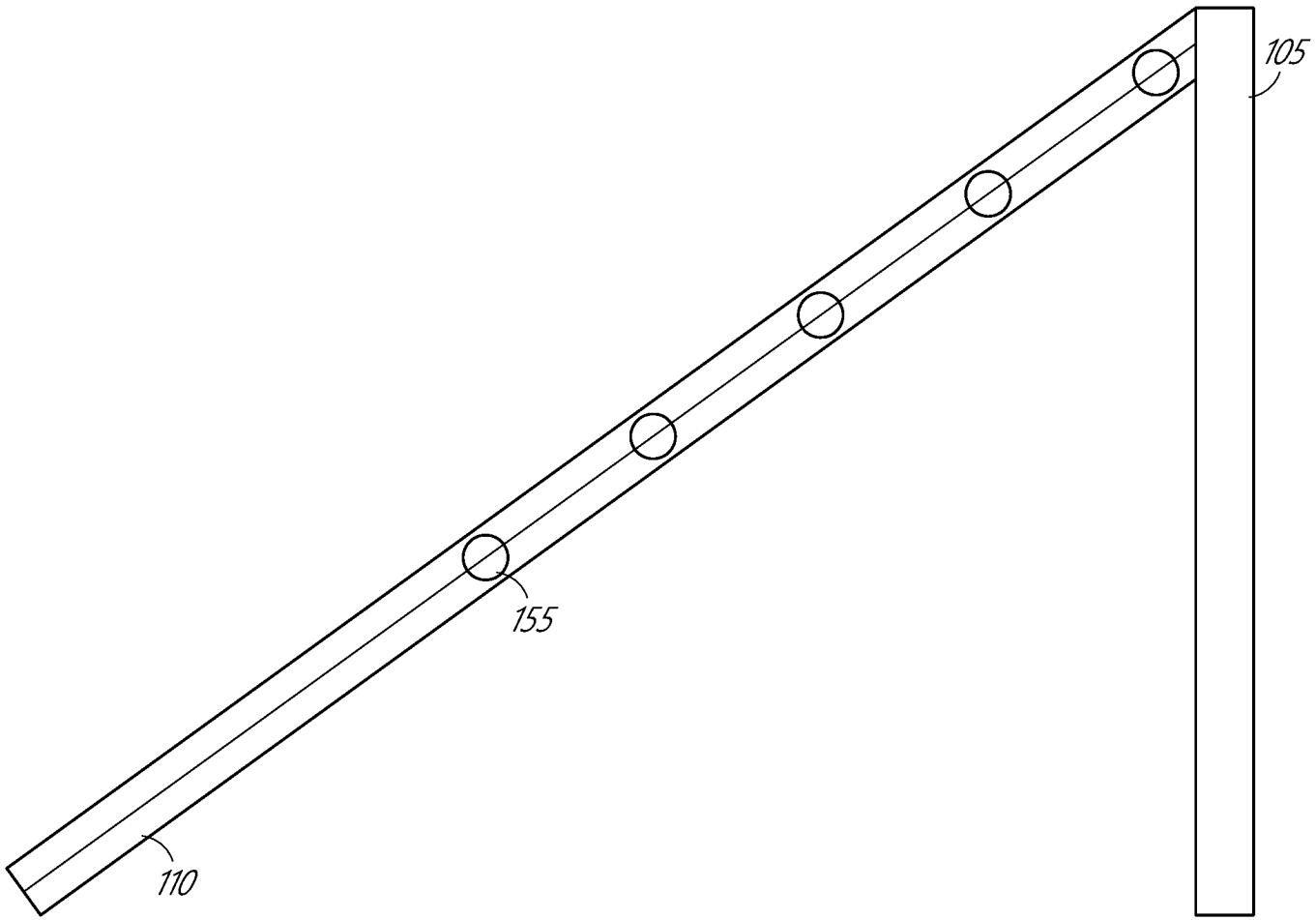
FIG. 4 illustrates holes 155 configured to receive sections of crossbars 115, which make possible the embodiment in FIG. 1 where the crossbars 115 extend through the back legs 110 and are attached by nuts 160.

FIGS. 1 and 3*b* illustrate an exemplary embodiment of how crossbars 115 and back legs 105 can be configured to connect to one another. In embodiments of this kind, crossbars 115 at each end extend through one or the other of back legs 110, which contain holes 155 (illustrated in FIG. 4) configured to receive sections of crossbars 115. In some embodiments, the holes 155 are drilled holes or laser cut holes. Referring to FIG. 3*b*, the ends of crossbars 115 extending beyond holes 155 are connected to nuts 160, which can be a nut or any other suitable securing mechanism.

Figure 5:
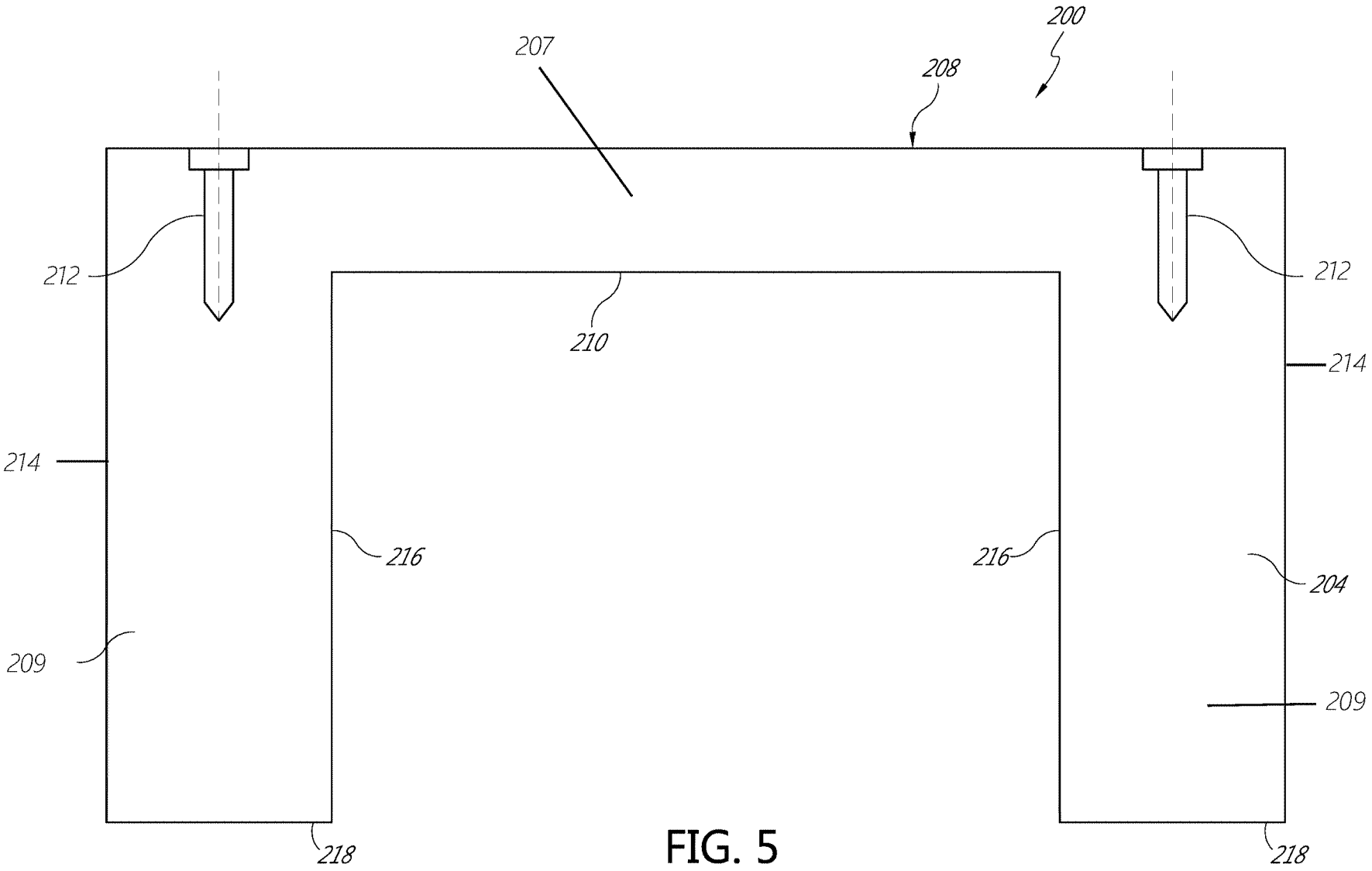
FIG. 5 illustrates a rear view of a shield 200.
Figure 6:
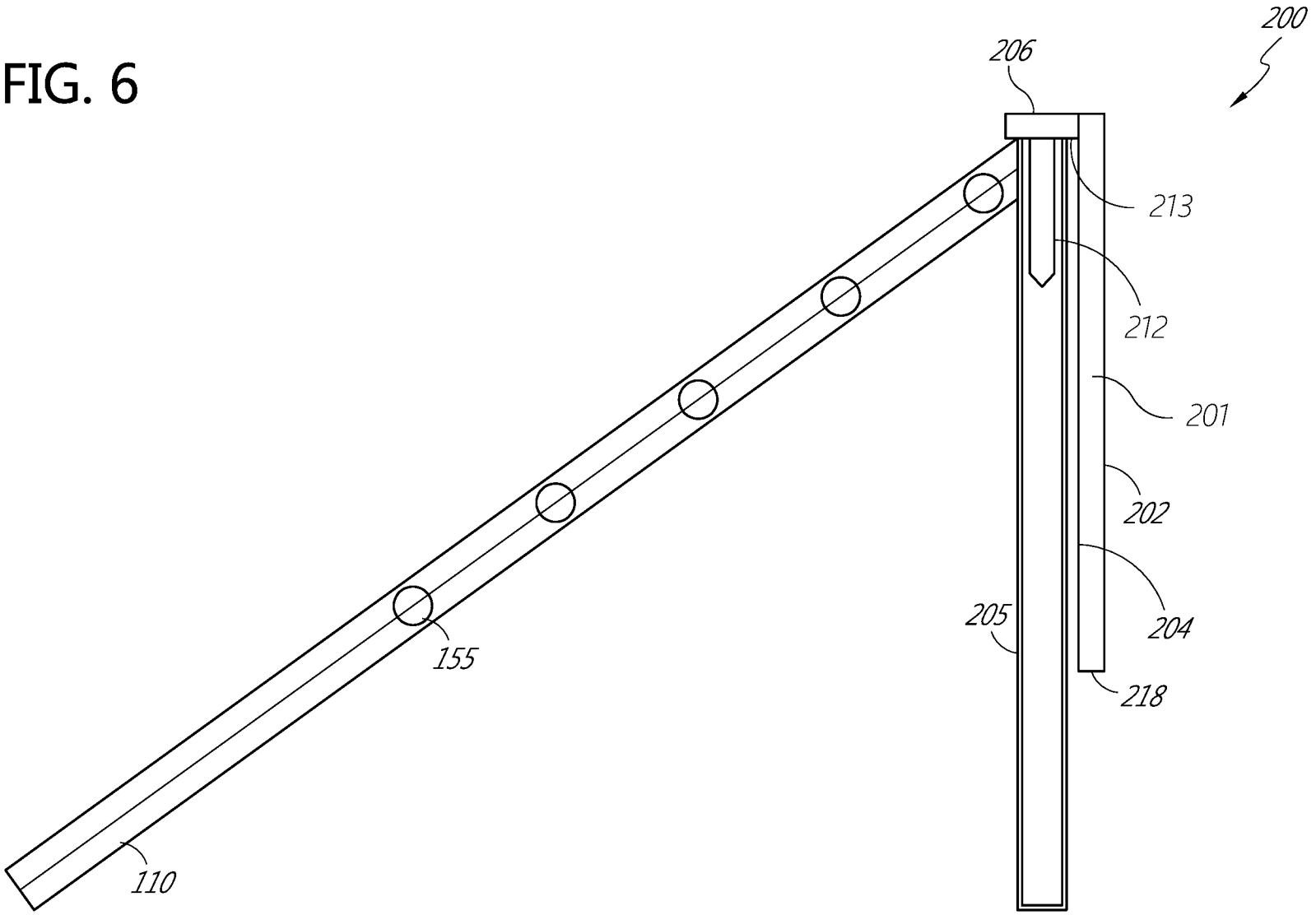
FIG. 6 illustrates a side view of a shield 200 attachment installed in a modified embodiment of a shooting target 100.
Figure 7:
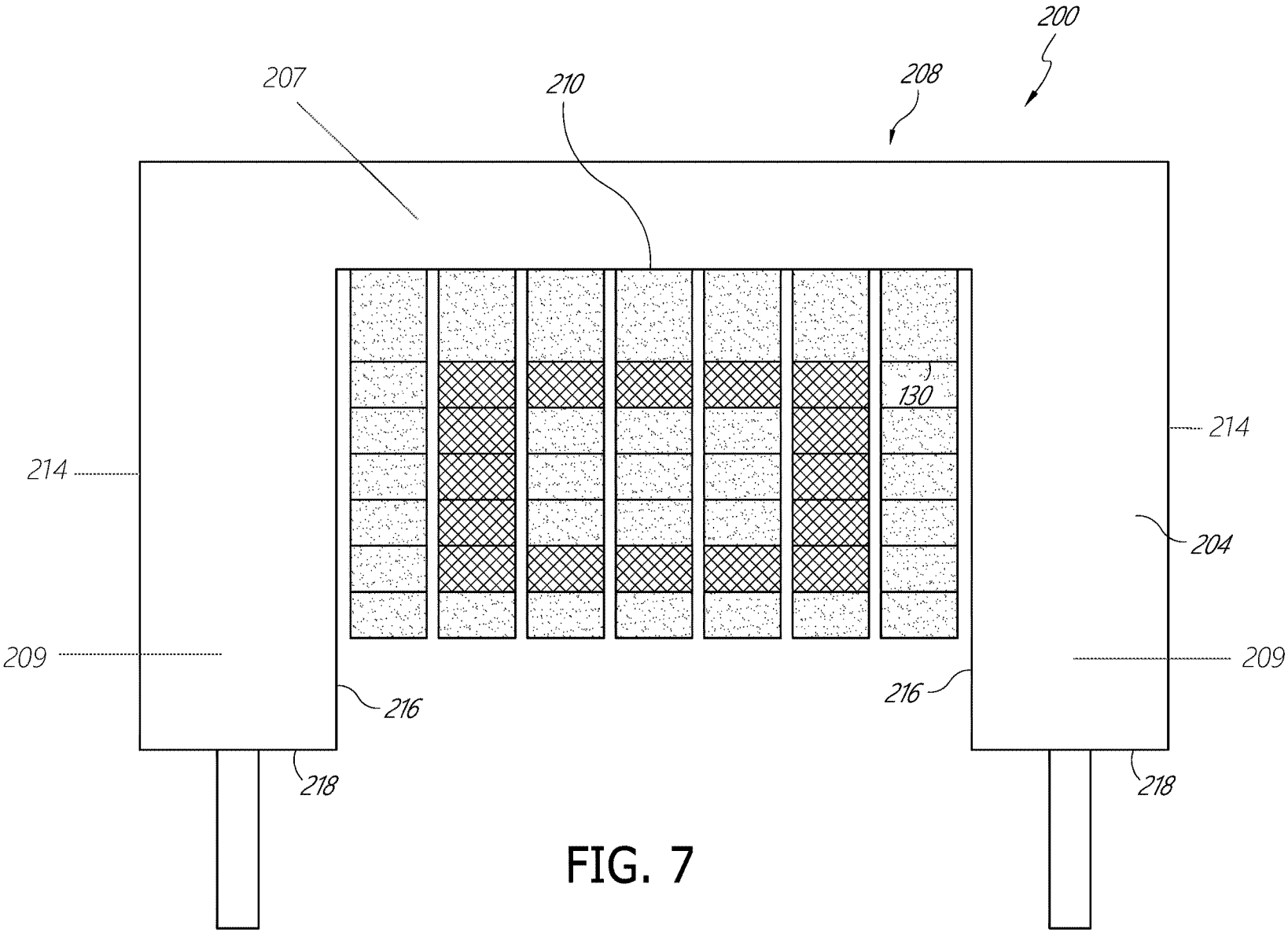
FIG. 7 illustrates a front view of a shield 200 attachment installed in a modified embodiment of a shooting target 100.

As illustrated in FIGS. 5-7, the shooting target 100 coupled with a shield 200 in a shooting target system. The shield 200 includes a body 201, a plate 206, and two support rods 212. Each of the support rods 212 may be coupled to the body 201 by a separate plate 206 or the support rods 212 may be coupled to the body 201 by a single plate 206. The body 201 includes a crossbar 207 and two legs 209. Both the crossbar 207 and legs 209 have a front portion 202 and a rear portion 204. In some embodiments, the thickness of the body 201 between the front portion 202 and the rear portion 204 is approximately ⅜ inches. The crossbar 207 has a top side 208 and a bottom side 210. In some embodiments, the top side 208 is approximately 13.5 inches and the bottom side 210 is approximately 8 inches. In some embodiments, the crossbar 207 is wider than the crossbar 115 of the shooting target 100. In some embodiments, the crossbar 207 is about the same width as the crossbar 115. Each leg 209 has a long side 214, a short side 216 opposite the long side 214, and a bottom side 218. In some embodiments, the long side 214 is approximately 10 inches, the short side is approximately 8 inches and the bottom side 218 is approximate 2.75 inches. In some embodiments, the legs 209 are wider (in a direction between the long side 214 and the short side 216) than front legs 105 of the shooting target 100. In other embodiments, the legs 209 are about the same width as front legs 105. The crossbar 207 extends between the two legs 209, so that together the crossbar 207 and the two legs 209 form a "U" shaped profile. In some embodiments, the crossbar 207 and legs 209 are formed from a single piece of material. In other embodiments, the crossbar 207 and legs 209 are formed from separate materials and are connected together through mechanical means (e.g. fasteners) or more permanent means (e.g. welding or formed as unified piece). In general, however, each support rod 212 is connected to the body 201 by a plate 206. Thus, there may be as many plates 206 as support rods 212.

In some embodiments, the plate 206 can detachably connect to the body 201 using common mechanical fasteners (e.g. nuts and bolts). In some of these embodiments, the fasteners are installed in countersunk holes, so as not to expose the fasteners to bullets. In other embodiments, more permanent methods (e.g. welding, bonding) are used to connect the plate 206 to the body 201. In other embodiments, the plate 206 and body 201 are formed from the same material. In some embodiments, each plate 206 has a width (measured in a direction parallel to the top side 208) of approximately 1 inch and a depth (measured in a direction perpendicular to its width) of approximately 0.25 inches. In some embodiments, each plate 206 is formed of mild steel. In some embodiments, a top portion of the plate 206 is a 1 inch by 1 inch square portion welded approximately an ⅛ inch below the top of the body 201 (on the rear portion 204). In some embodiments, the support rods 212 connects to the plate 206 by a common mechanical fastener. In other embodiments, the support rods 212 are connected to the plate through a more permanent method (e.g. welding, bonding). The support rods 212 are sized to be narrower than the opening of a modified leg 205 so that the support rod 212 can extend through the opening of the modified leg 205. In some embodiments, the support rods 212 are each about 3 inches in length (as measured from the attachment to the plate 206 to the tip furthest therefrom). In some embodiments, the support rods 212 each have an approximately cylindrical body approximately ½ inch in diameter. In some embodiments, the support rods 212 are formed of rod mild steel and are each welded to a center of a 1 inch by 1 inch plate 206 formed of mild steel. In some embodiments, a gap of approximately ¼ inch is created between the support rods 212 and the rear portion 204 of the body 201.

As can be seen in FIG. 6 in a shooting target system, the shield 200 is installed on a modified shooting target (without any rotary targets 130 shown in this figure for ease of understanding) by placing the support rods 212 through the opening at the top of the modified leg 205. The modified leg 205 is installed in place of the front leg 105, creating the modified shooting target. The modified leg 205 has a hollow body, which allows for the support rod 212 to be placed within the hollow body and thereby to support the shield 200. When installed on the modified shooting target, the body 201 covers, from a forward direction, the crossbar 115 and part of the modified legs 205. In some embodiments, the legs 209 have a longer length such that the legs 209 cover, from a forward direction, the entire modified leg 205 (e.g. the bottom 218 of the legs 209 is flush with the bottom of the modified legs 205 when the shield 200 is installed). In some embodiments, the width of the crossbar 207 and legs 209 are sized so as not block a bullet from hitting a rotary target 130. In some embodiments, the body 201 extends a short distance 213 out from the front of the modified legs 212 when the shield 200 is installed. In some embodiments, the shield 200 can prevent bullets from hitting and damaging the components of the modified shooting target, such as, for example, the legs 205, crossbar 115, nuts 160, and bolts 165.

FIG. 7 illustrates a front view of a shooting target system with both a modified shooting target having a shield 200 in place. In this embodiment, seven rows of rotary targets 130 are illustrated with a single approximately cylindrical target design in cross-hatch. (The crossbars 115 holding up each row of rotary targets 130 are not illustrated in this figure, but portions of each crossbar 115 other than the top row crossbar would normally be visible between columns of rotary targets 130 in this type of front view of a shooting target system.) Back legs 105, would also be hidden behind the modified front legs 205, and thus, would not be visible from the front view in FIG. 7. Nevertheless, portions of the shield 200 including a crossbar 207 having a top side 208 and a bottom side 210, and legs 209 having a front portion 202 with a long side 214 opposite a short side 216 and a bottom side 218. The modified legs 205 are illustrated protruding below the bottom side 218 of the legs 209. The shield 200 functions to protect all "hidden" (or protected) components from being hit by a bullet (or other device) when a shooter is aiming to hit one of the rotary targets 130. Thus, the shield may be formed of a "tougher" material than some of the "hidden" or protected components in the shooting target system.

The body 201, plate 206, and support rods 212 can be manufactured using a variety of different materials and methods. For example, the body 201, plate 206, and support rods 212 may be made of any suitably strong and durable material, such as, for instance, metal (e.g., aluminum or steel), metal alloy (e.g., aluminum alloys), reinforced plastic, a plastic material, or other materials described herein. The body 201, plate 206, and support rods 212 may be made by any suitable process, such as, for instance, machining, milling, water jet cutting, laser cutting, stamping, pressing, sheet metal drawing, molding, casting, rapid prototyping using additive manufacturing techniques, or any combination thereof.

Although the foregoing has been described in some detail by way of illustrations and examples for purposes of clarity and understanding, it will be understood by those of skill in the art that numerous and various modifications can be made without departing from the spirit of the present disclosure. Therefore, it should be clearly understood that the forms disclosed herein are illustrative only and are not intended to limit the scope of the present disclosure, but rather to also cover all modification and alternatives coming with the true scope and spirit of the invention.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

What is claimed is:

1. A reusable shooting target, comprising:

a plurality of rotary targets, each rotary target comprising:

a flat target plate section having a bottom edge, a top edge, a front side, and a back side, wherein the top edge and bottom edge define a top-to-bottom length of the target plate section, and wherein all of the rotary targets of the plurality of rotary targets have the same top-to-bottom length; and a pivot section, wherein the top edge of the flat target plate section is attached to the pivot section and extends downward directly beneath the pivot section, and wherein the front side and the back side of the target plate section are substantially flat;

a plurality of crossbars, each crossbar comprising a first end, a body portion, and a second end, and each crossbar supporting a tier of rotary targets;

two or more vertical front legs, each front leg comprising a bottom end, a body portion, and a top end; and a plurality of sloped back legs, each individual back leg comprising a back end, a body portion, and a front end;

wherein the rotary targets, the crossbars, the vertical front legs, and the sloped back legs together form a reusable firearms shooting target;

wherein the body portion or top end of each front leg is fixedly attached to the front end of one of the back legs such that an angle of between 40 degrees and 70 degrees is formed between the vertical front legs and the sloped back legs, wherein the first end of each crossbar is fixedly or removably attached to the body portion of one of the sloped back legs, and wherein the second end of each crossbar is fixedly or removably attached to the body portion of another one of the sloped back legs;

wherein the pivot section of each rotary target is fixedly or removably attached to the body portion of one of the crossbars, such that the target plate section of the rotary target is positioned below the crossbar to which the pivot section of such rotary target is attached with the top edge of the target plate section located directly beneath the crossbar;

wherein the pivot section of each rotary target and the crossbar to which the pivot section is attached are together adapted such that when hit with a bullet the rotary target spins around an axis aligned with the respective crossbar to which the rotary target is attached, and wherein;

wherein the rotary targets adjacent to each other on an crossbar are separated from one another by a first distance that is less than 0.500 inches;

wherein the crossbars adjacent to each other are separated by a second distance, wherein the top-to-bottom length of the target plate section is great enough to hide a crossbar located directly behind the target plate section and a top portion of the tier of targets attached to such crossbar, and wherein the top-to-bottom length is less than the second distance so that each rotary target, when spinning completely around the crossbar to which the pivot section of such rotary target is attached, will not collide with any other rotary target or crossbar; and wherein each of the front legs, the back legs, the crossbars, and the rotary targets comprise at least one bullet-resistant material.

2. The reusable shooting target of claim 1, wherein the first distance is less than 0.200 inches.

3. The reusable shooting target of claim 1, wherein the first distance is less than 0.040 inches.

4. The reusable shooting target of claim 1, wherein the front legs, the back legs, the crossbars, or the rotary targets comprise mild steel.

5. The reusable shooting target of claim 1, wherein the front legs, the back legs, the crossbars, and the rotary targets comprise steel with a Brinell value of about 400 to 500 HB.

6. The reusable shooting target of claim 1, wherein the front legs, the back legs, the crossbars, and the rotary targets comprise steel with a Brinell value of about 500 to 700 HB.

7. The reusable shooting target of claim 1, wherein the target plate sections comprise at least one weather-resistant coating or decorative paint.

8. The reusable shooting target of claim 1, wherein:

the body portion of each of the back legs includes a plurality of holes configured to receive the first ends or the second ends of the crossbars;

the first end of each crossbar is mated with one of the holes of a first back leg of the plurality of back legs and extends through the back leg to the opposite side;

the second end of each crossbar is mated with one of the holes of a second back leg of the plurality of back legs and extends through the back leg to the opposite side; and each first end and second end of the crossbars is secured to a nut.

9. The reusable shooting target of claim 1, wherein the rotary targets are separated from the back legs by threaded nuts disposed between the rotary targets and the back legs.

10. The reusable shooting target of claim 1, further comprising a support surface, and wherein the bottom end of each of the two or more front legs is configured to be fixedly or removably attached to the support surface.

11. The reusable shooting target of claim 1, further comprising a support surface, and wherein the bottom end of each of the two or more front legs is configured to be fixedly or removably inserted into the support surface.

12. The reusable shooting target of claim 1, further comprising a support surface, and wherein the back end of each individual back leg of the plurality of back legs is configured to be fixedly or removably attached to the support surface.

13. The reusable shooting target of claim 1, further comprising a support surface, and wherein the back end of each individual back leg of the plurality of back legs is configured to be fixedly or removably inserted into the support surface.

14. A reusable shooting target, comprising:

a plurality of rotary targets, each rotary target comprising:

a target plate section having a bottom end, a top end, a front end, and a back end; and a pivot section, the top end of the target plate section fixedly or removably attached to the pivot section, and the front end and the back end of the target plate section are substantially flat;

at least three crossbars, each crossbar comprising a first end, a body portion, and a second end;

two or more vertical front legs, each front leg comprising a bottom end, a body portion, and a top end; and a plurality of sloped back legs, each individual back leg comprising a back end, a body portion, and a front end;

wherein the rotary targets, the crossbars, the vertical front legs, and the sloped back legs together form a reusable firearms shooting target;

wherein the body portion or top end of each front leg is fixedly attached to the front end of one of the back legs, the first end of each crossbar of the at least three crossbars is fixedly or removably attached to the body portion of one of the sloped back legs, and the second end of each crossbar of the at least three crossbars is fixedly or removably attached to the body portion of another one of the sloped back legs;

wherein the pivot section of each rotary target is fixedly or removably attached to the body portion of one of the crossbars, such that the target plate section of the rotary target is positioned below the crossbar to which the pivot section of such rotary target is attached;

wherein each crossbar is disposed below any and all crossbars in front of such crossbar, and is disposed above any and all crossbars behind such crossbar;

wherein each crossbar supports a tier of at least three rotary targets, and wherein the tier of rotary targets on each crossbar is disposed below the tier of rotary targets on any and all crossbars in front of such crossbar, and are disposed above the tier of rotary targets on any and all crossbars behind such crossbar such that a grid of successively descending tiers of rotary targets are presented to a shooter;

wherein the pivot section of each rotary target and the crossbar to which the pivot section is attached are together adapted such that when hit with a bullet the rotary target spins around an axis aligned with the respective crossbar to which the rotary target is attached;

wherein the rotary targets adjacent to each other on an crossbar are separated from one another by a first distance that is less than 0.500 inches; and wherein each of the front legs, the back legs, the crossbars, and the rotary targets comprise at least one bullet-resistant material.

* * * * *